US008052446B1

(12) United States Patent
Chen et al.

(10) Patent No.: US 8,052,446 B1
(45) Date of Patent: Nov. 8, 2011

(54) ELECTRICAL CONNECTOR WITH IMPROVED TERMINALS

(75) Inventors: Yen-Lin Chen, Taipei Hsien (TW); Yen-Hsun Chen, Taipei Hsien (TW)

(73) Assignee: Taiwan Suncagey Industrial Co., Ltd., Wugu Township, Taipei Hsien (TW)

( * ) Notice: Subject to any disclaimer, the term of this patent is extended or adjusted under 35 U.S.C. 154(b) by 0 days.

(21) Appl. No.: 12/829,378

(22) Filed: Jul. 1, 2010

(51) Int. Cl.
*H01R 13/50* (2006.01)

(52) U.S. Cl. ..... 439/260

(58) Field of Classification Search ..... 439/260, 439/493, 495, 329
See application file for complete search history.

(56) References Cited

U.S. PATENT DOCUMENTS 4,966,557 A * 10/1990 Barkus et al. ..... 439/246
5,139,446 A * 8/1992 Costello et al. ..... 439/751
* cited by examiner

*Primary Examiner* — Tulsidas Patel
*Assistant Examiner* — Phuong Nguyen
(74) *Attorney, Agent, or Firm* — Cheng-Ju Chiang

(57) ABSTRACT

An electrical connector with improved terminals, includes a dielectric housing having a connecting end, a mating end opposite to the connecting end, a plurality of slots arranged therein, a plurality of stop grooves formed adjacent to the connecting end and respectively adjoining and communicating with the corresponding slots, a plurality of terminals mounted in the corresponding slots, each of the terminals including a body, a first contact arm and a second contact arm, the first and the second contact arms cooperatively defining a clamping area therebetween, a retention arm formed on a substantially middle of the body and bending outwards of the body, wherein the retention arm is held against the stop groove so as to prevent the terminals from being loosened out of the slots by an excessive insertion force from a mating connector.

5 Claims, 2 Drawing Sheets

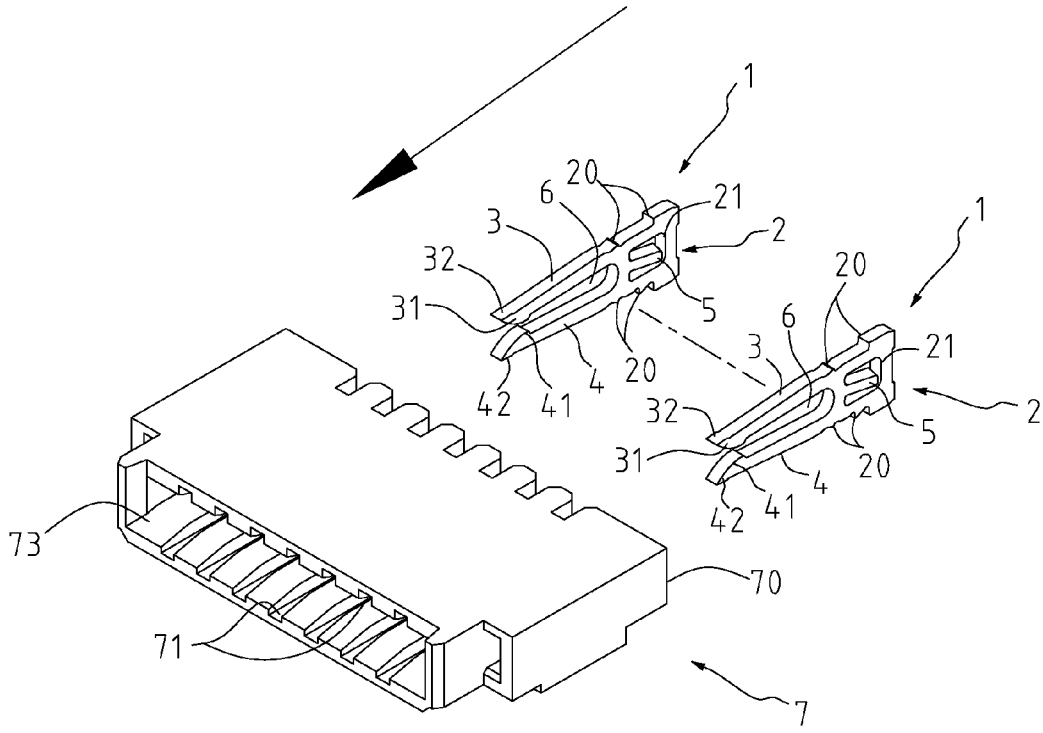
FIG.1
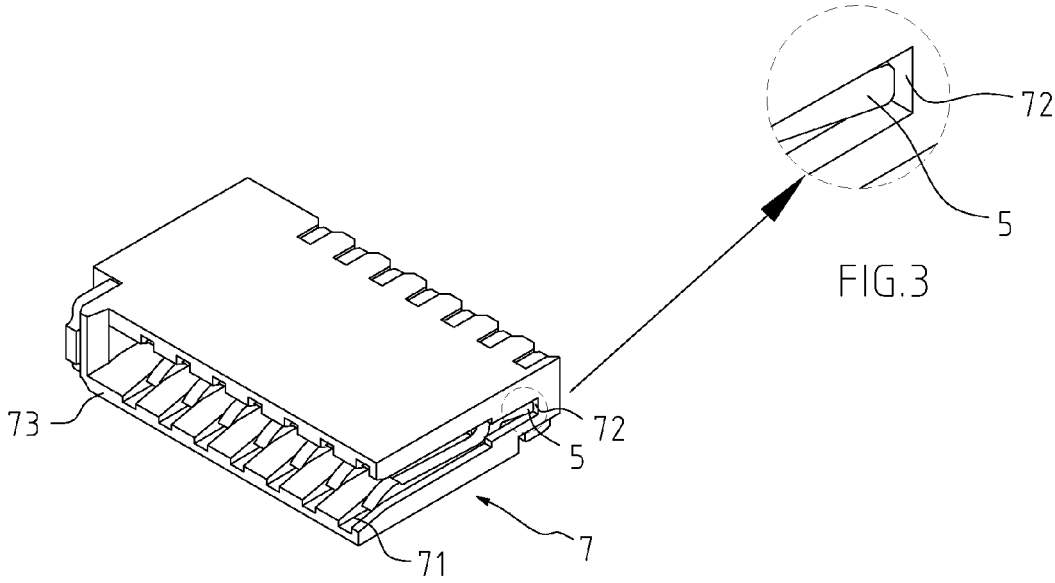
FIG.3
FIG.2

ELECTRICAL CONNECTOR WITH IMPROVED TERMINALS

BACKGROUND OF THE INVENTION

1. Field of the Invention

The present invention relates to an electrical connector, and particularly to a thin-type electrical connector with improved terminals being securely mounted in a dielectric housing of the electrical connector.

2. Related Art

As is well known, an electrical connector usually includes a housing and terminals which are secured in the housing by an interference fit. However, conventional terminals are unable to keep an appropriate interference fit with the housing as expected because thickness of the housing of the electrical connector is designed to be as small as possible to keep up with a trend of thin-type configuration. In particular, the terminals in the housing tend to be affected in positions or even loose when the electrical connector is mated with an excessive insertion force. Though the terminals are able to be secured in the housing by Insert Molding, the method of Insert Molding still has drawbacks of higher cost and limited manufacturing process.

SUMMARY OF THE INVENTION

Accordingly, an object of the present invention is to provide an electrical connector with improved terminals having retention arms to enable the terminals to be securely mounted in a dielectric housing of the electrical connector so that to prevent terminals from being loosen after being mated with a mating connector.

To achieve the above-mentioned object, the electrical connector with improved terminals of the present invention includes a dielectric housing having a connecting end, a mating end opposite to the connecting end, a plurality of slots arranged therein, a plurality of stop grooves formed adjacent to the connecting end and respectively adjoining and communicating with the corresponding slots, a plurality of terminals mounted in the corresponding slots, each of the terminals including a body, a first contact arm and a second contact arm, the first and the second contact arms cooperatively defining a clamping area therebetween, a retention arm formed on a substantially middle of the body and bending outwards of the body, wherein the retention arm is held against the stop groove so as to prevent the terminals from being loosened out of the slots by an excessive insertion force from a mating connector.

Furthermore, the first and the second contact arms are respectively provided with a protrusion for interferentially engaging the slot of the dielectric housing after the electrical connector mates with the mating connector so as to reinforce a clamping force from the first and the second contact arms.

BRIEF DESCRIPTION OF THE DRAWINGS

FIG. 1 is a perspective exploded view of an electrical connector with improved terminals of the present invention;

FIG. 2 is a partially assembly view of FIG. 1;

FIG. 3 is a partially enlarged view of FIG. 2;

DESCRIPTION OF THE PREFERRED EMBODIMENTS

Figure 4:
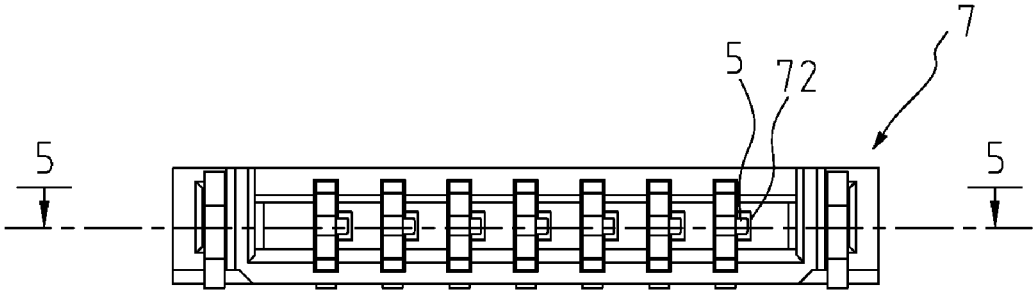
FIG. 4 is a front elevational view of FIG. 1 in which the terminals are mounted in the electrical connector.
Figure 5:
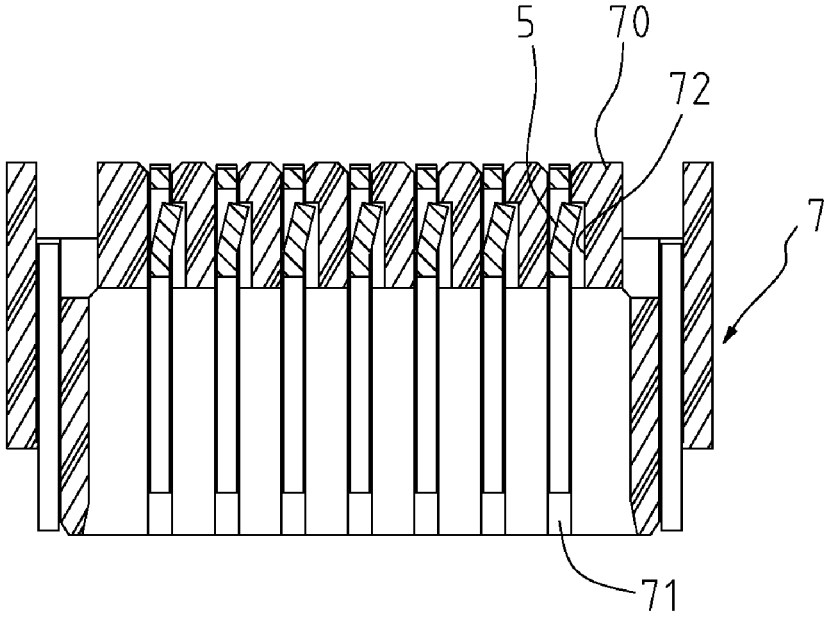
FIG. 5 is a cross-sectional view taken along line 5-5 of FIG. 4.

Referring to FIG. 1, an electrical connector with improved terminals includes a dielectric housing 7 and a plurality of terminals 1. The dielectric housing 7 has a connecting end 70, a mating end 73 opposite to the connecting end 70, a plurality of slots 71 are arranged in the dielectric housing 7 and pass through the connecting end 70 and the mating end 73, and a plurality of stop grooves 72 are formed adjacent to the connecting end 70 and respectively adjoin and communicate with the corresponding slots 71 (referring to FIG. 2). The plurality of terminals 1 are of a flat shape and mounted in the corresponding slots 71, each of the terminals 1 including a body 2, a first contact arm 3, a second contact arm 4, and a retention arm 5, wherein a peripheral of the body 2 is provided with multiple interference portions 20, the interference portions 20 protrude outwards from opposite sides of the body 2 and are spaced away from each other to form a rough contact face against inner walls of the slot 71 so as to strengthen the interference engagement therebetween, and a hollow portion 21 is formed in a substantially middle portion of the body 2. The body 2 of each terminal 1 further comprises a body end neighboring the connecting end 70 of the housing 7, and the body end exposes at the top surface of the housing 7 and is flush therewith. The first contact arm 3 and the second arm 4 are disposed at one side of the body 2 and spaced apart from each other to form a fork-like shape, and cooperatively define a clamping area 6 therebetween where contacts of a mating connector (not shown) are inserted in, wherein a bump 31, 41 is formed on front ends of the first contact arm 3 and the second contact arm 4, and faces towards the clamping area 6 for electrically contacting the contacts of the mating connector. Furthermore, the first and the second contact arms 3, 4 are respectively provided with a protrusion 32, 42 on an outer edge thereof for interferentially engaging the slot 71 of the dielectric housing 7 after the electrical connector mates with the mating connector. One end of the retention arm 5 is integrally formed with an inner wall of the hollow portion 21, and the other end of the retention arm 5 is held against the stop groove 72 by bending the retention arm 5 outwards of the body 2 in an opposite direction with respect to the clamping area 6 and towards the connecting end 70 of the dielectric housing 7 (referring to FIGS. 3 and 5).

In assembly, the terminals 1 are mounted in the corresponding slots 71 from the connecting end 70 of the dielectric housing 7, the interference portions 20 of the terminals 1 are in interference engagement with inner walls of the slots 71, and the retention arm 5 is held against the stop groove 72 of the dielectric housing 7 (referring to FIGS. 3 and 5) to prevent the terminals 1 from being loosened out of the slots 71 when the contacts of the mating connector are inserted in the clamping area 6 with an excessive insertion force so that the terminal 1 are mounted securely in the slots 71. Moreover, when the electrical connector of the present invention is connected with the mating connector, the first and the second arms 3, 4 are capable of clamping the contacts of the mating connector in the clamping area 6 with the bumps 31, 41, and the protrusions 32, 42 of the first and the second contact arms 3, 4 reinforce a clamping force from the bumps 31, 41 of the first and the second contact arms 3, 4.

It is understood that the invention may be embodied in other forms within the scope of the claims. Thus the present examples and embodiments are to be considered in all respects as illustrative, and not restrictive, of the invention defined by the claims.

What is claimed is:

1. An electrical connector, comprising:

a dielectric housing having a connecting end, a mating end opposite to the connecting end for allowing insertion of a mating connector, a plurality of slots arranged in the dielectric housing and passing through the connecting end and the mating end, and a plurality of stop grooves formed adjacent to the connecting end and respectively adjoining and communicating with the corresponding slots; and a plurality of terminals mounted in the corresponding slots, each of the terminals including a body, a first contact arm and a second contact arm both disposed at one side of the body and being opposite to each other, the first contact arm and the second contact arm cooperatively defining a clamping area therebetween, a retention arm being formed on a substantially middle of the body and bending outwards of the body in an opposite direction with respect to the clamping area and towards the connecting end of the dielectric housing, and a plurality of interference portions protruding outwards from opposite sides of the body and being spaced away from each other;

wherein the retention arm is held against the stop groove so as to prevent the terminals from being loosened out of the slots by an excessive insertion force from the mating connector;

wherein the body of the terminal has a hollow portion thereon, one end of the retention arm is integrally formed with an inner wall of the hollow portion, and the other end of the retention arm is held against the stop groove by bending the retention arm outwards of the body in a direction, which is perpendicular to a direction defined along the insertion of the mating connector.

2. The electrical connector of claim 1, wherein the first contact arm and the second contact arm are spaced apart from each other to form a fork-like shape, the first contact arm and the second contact arm respectively form a bump at a front end thereof, the bump facing towards the clamping area.

3. The electrical connector of claim 2, wherein the first contact arm and the second contact arm are respectively provided with a protrusion on an outer edge thereof for interferentially engaging the slot of the dielectric housing after the electrical connector mates with the mating connector.

4. The electrical connector of claim 1, wherein the body of the each of the terminals comprises a body end and the body end exposes at a surface of the housing neighboring the connecting end thereof.

5. The electrical connector of claim 4, wherein the exposed body end of the body is flush with the surface of the housing.

* * * * *